US005611661A

United States Patent [19]

Jenkinson

[11] Patent Number: 5,611,661

[45] Date of Patent: Mar. 18, 1997

[54] GAS TURBINE ENGINE WITH BEARING CHAMBERS AND BARRIER AIR CHAMBERS

[75] Inventor: John Jenkinson, Bristol, Great Britain

[73] Assignee: BMW Rolls-Royce GmbH, Munich, Germany

[21] Appl. No.: 530,175

[22] PCT Filed: Mar. 18, 1994

[86] PCT No.: PCT/EP94/00854

§ 371 Date: Nov. 30, 1995

§ 102(e) Date: Nov. 30, 1995

[87] PCT Pub. No.: WO94/23184

PCT Pub. Date: Oct. 13, 1994

[30] Foreign Application Priority Data

Apr. 1, 1993 [GB] United Kingdom ..... 9306890

[51] Int. Cl.[6] ..... F01D 25/18

[52] U.S. Cl. ..... 415/112; 415/176; 60/39.08; 184/6.11

[58] Field of Search ..... 415/112, 175, 415/176; 60/39.08; 184/6.11

[56] References Cited

U.S. PATENT DOCUMENTS

| | | | |
|---|---|---|---|
| 3,527,054 | 9/1970 | Hemsworth | 415/112 |
| 3,722,624 | 3/1973 | Buckland . | |

FOREIGN PATENT DOCUMENTS

| | | |
|---|---|---|
| 0354422 | 2/1990 | European Pat. Off. . |
| 2002762 | 9/1970 | Germany . |
| 702931 | 1/1954 | United Kingdom . |
| 2111607 | 7/1983 | United Kingdom . |

*Primary Examiner*—James Larson
*Attorney, Agent, or Firm*—Evenson, McKeown, Edwards & Lenahan, P.L.L.C.

[57] ABSTRACT

An aircraft gas turbine has a barrier air flow produced by the fan or a low-pressure compressor which passes continuously through the compressor bearing chamber, while the turbine bearing chamber is supplied with barrier air by the high-pressure compressor. The barrier air flow drawn from the turbine bearing chamber passes into an ejector which is also connected to the compressor bearing chamber so that, when the pressure is insufficient, the barrier air flow is drawn-off by the ejector.

3 Claims, 1 Drawing Sheet

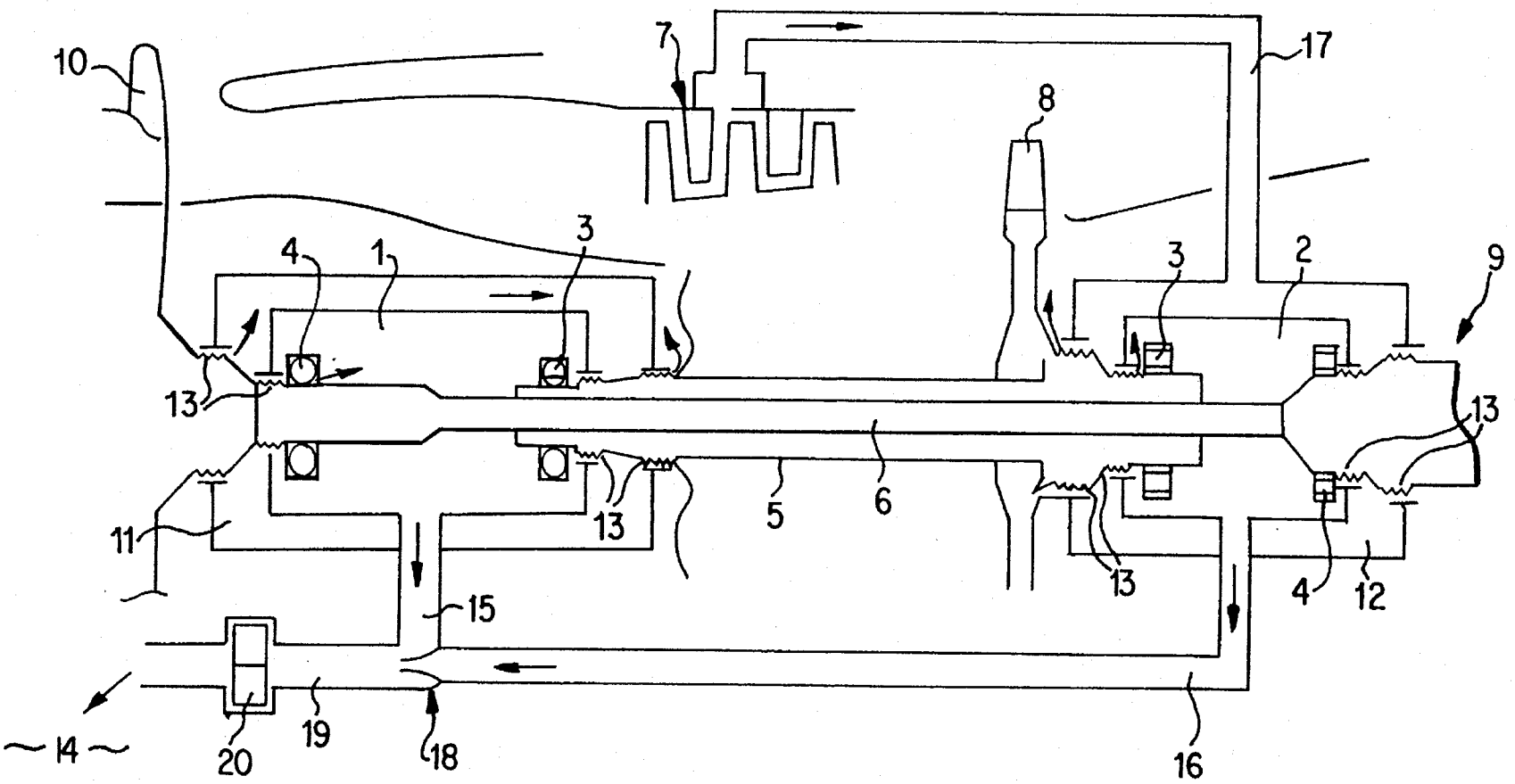
9
13
12
4
2
17
16
3
13
8
6
5
7
13
3
15
18
1
19
4
20
13
11
10
14

GAS TURBINE ENGINE WITH BEARING CHAMBERS AND BARRIER AIR CHAMBERS

BACKGROUND AND SUMMARY OF THE INVENTION

The invention relates to a gas turbine engine, especially an aircraft gas turbine engine, with a compressor bearing chamber and a turbine bearing chamber. Barrier air chambers surround the bearing chambers that are supplied with oil. The barrier air chambers are supplied with a barrier air flow by a low-pressure compressor or fan and a high-pressure compressor. The flow passes at least partially into the associated bearing chambers through labyrinth seals and is conducted away from the bearing chambers through an oil separator, especially into the environment. Reference is made to Great Britain Patent document GB-B- 702 931 as an example of the prior art.

The seals provided in the bearing chambers for the shafts of a gas turbine engine between the bearing chamber wall as well as the shaft passing therethrough are necessary to prevent lubricating oil or an oil mist from entering the compressor or the turbine. This seal must be made contact-free, so that usually labyrinth seals are used which are, however, additionally traversed by a barrier air flow to achieve an optimum sealing effect. This barrier air flow comes from a barrier air chamber surrounding the bearing chamber through the labyrinth seals into the bearing chamber and is conducted out of the latter through an oil separator, preferably into the environment, but could also be used later in another fashion.

In order to ensure the flow of barrier air described above from the barrier air chambers into the bearing chambers and from the latter into the environment for example, a certain pressure drop is always required between the barrier air chambers and the environment, i.e. the pressure in the barrier air chambers must be larger by a certain amount than that downstream from the bearing chambers. Therefore, it is conventional to supply the barrier air chambers from the low-pressure compressor, which can also be designed as a fan, or from the high-pressure compressor with a barrier air flow. However, during the operation of a gas turbine engine, operating points can occur in which the pressure delivered by the low-pressure compressor or fan is not sufficient to deliver a barrier air flow which overcomes the flow resistances, for example, in the labyrinth seals, through the barrier air chambers, as well as the bearing chambers, and then through an oil separator and into the environment. Great Britain Patent document GB-B- 702 931 mentioned above therefore proposes to tap off the barrier air flow from the high-pressure compressor in these cases.

This known prior art is disadvantageous because not only is a separate switching valve required, with the aid of which the barrier air flow is tapped off either from the low-pressure compressor or fan or from the high-pressure compressor. Also this known prior art is disadvantageous because each of the bearing chambers is exposed at least temporarily to a relatively high-temperature barrier air flow, since, as is known, a definitely elevated temperature level prevails in high-pressure compressors.

There is therefore needed an improved and simplified manner of providing barrier air supply to a gas turbine engine, especially one for an aircraft gas turbine, having a compressor bearing chamber, a turbine bearing chamber and barrier air chambers surrounding the compressor and turbine bearing chambers. The barrier air chambers are supplied by a low pressure compressor or fan and a high-pressure compressor with a barrier air flow. The barrier air flow passes through labyrinth seals at least partially into an associated bearing chamber and is carried away from the latter through an oil separator.

These needs are met according to the present invention by a gas turbine engine wherein the compressor barrier air chambers are supplied by the low-pressure compressor or fan and wherein the turbine barrier air chambers are supplied with barrier air from the high-pressure compressor. The barrier air flow emerging from the compressor bearing chambers is mixed in an ejector with the barrier air flow emerging from the turbine bearing chambers. For an advantageous improvement, the oil separator can then be provided downstream from the ejector.

According to the present invention, therefore, the compressor bearing chambers are always exposed to a barrier air flow delivered by the low-pressure compressor or a fan, while the turbine bearing chambers are always supplied by a barrier air flow that is delivered by a high-pressure compressor. In this manner, first of all the switching valve known from the prior art can advantageously be eliminated without replacement. In addition, the compressor bearing chambers then always receive a relatively low-temperature barrier air flow so that these bearing chambers can also be made of a material that would not withstand high temperatures, for example magnesium. However, in order to make sure that in the event of insufficient delivery pressure from the low-pressure compressor or fan, a barrier air flow would nevertheless be supplied in the desired direction through the bearing chambers, according to the present invention an ejector or extractor is provided which draws-off the barrier air flow flowing through the compressor bearing chambers from these bearing chambers. The pressure potential still present in the barrier air flow from the turbine bearing chambers is utilized for this purpose. With this arrangement, not only is a sufficient barrier air flow ensured in both bearing chambers at all operating points but, in addition, the lubricating oil circuit of the gas turbine engine is only minimally heated since the compressor bearing chambers are exposed at all operating points to a relatively cold barrier air flow.

Of course, in further preferred embodiments, additional bearing chambers or the like using the principle according to the invention could reliably be provided with a barrier air flow. In addition, it may be sufficient for the compressor barrier air chambers, as is necessarily required by the design, to be located in the downstream area of the fan so that even without a separate barrier air supply line, a sufficient barrier air flow can pass from this fan into the compressor barrier air chambers. Moreover, in a barrier air supply system according to the invention, if the required oil separator is located downstream from the ejector, firstly this means that only a single oil separator is required and, secondly, this oil separator does not make itself felt in a harmful manner by reducing the pressure, i.e. upstream from the ejector or extractor a sufficiently high pressure level prevails to ensure the barrier air supply system according to the invention. This is also evident from the schematic diagram explained below of a preferred embodiment. Only those elements of a gas turbine engine according to the invention required for understanding have been included.

BRIEF DESCRIPTION OF THE DRAWING

The figure is a schematic block diagram of a gas turbine engine according to the present invention.

DETAILED DESCRIPTION OF THE DRAWING

Referring to the figure, reference numeral 1 refers to the compressor bearing chamber and reference numeral 2 refers to the turbine bearing chamber of an aircraft gas turbine. These bearing chambers 1, 2 each have two bearings 3, 4 by which, as may be seen, the high-pressure shaft 5 and the low-pressure shaft 6 are mounted. As usual, the low-pressure shaft 6 rotates inside the high-pressure shaft 5. High-pressure shaft 5 carries a high-pressure compressor 7, of which only a few blades are shown, as well as a high-pressure turbine 8, of which likewise only a single blade is shown. Similarly, the low-pressure shaft 6 carries a low-pressure turbine 9 on the turbine side and a fan 10 on the compressor side. The fan 10 is located upstream from the high-pressure compressor 7, but the fan can also be designed as a low-pressure compressor.

Compressor bearing chamber 1 is surrounded by a compressor barrier air chamber 11 and turbine bearing chamber 2 is surrounded by a turbine barrier air chamber 12. In the vicinity of the areas where shafts 5, 6 pass through the walls of bearing chambers 1, 2 or barrier air chambers 11, 12 zero-contact labyrinth seals 13 are provided. These labyrinth seals 13 are intended to prevent the lubricating oil located in the bearing chambers 1, 2 from entering the compressor area or the turbine area. As is known, to support this sealing effect, a barrier air flow is conducted from the respective barrier air chamber 11, 12 through the associated bearing chambers 1, 2 into the environment. The latter is indicated by reference numeral 14.

In bearing chambers 1, 2, the barrier air flow from the respective barrier air chambers 11, 12 enters through the labyrinth seals 13. The barrier air flow is carried away from the respective bearing chambers 1, 2 through exhaust lines 15 (for the compressor bearing chamber 1) or 16 (for the turbine bearing chamber 2). The barrier air flow can enter the compressor barrier air chamber 11 directly through the labyrinth seal 13 facing fan 10, while the turbine barrier air chamber 12 is supplied with barrier air through a feed line 17 from high-pressure compressor 7.

Operating points can occur at which the pressure level downstream from fan 10 is insufficient to ensure an adequate barrier air flow through compressor bearing chamber 1. Thus, there are operating points at which the pressure level downstream from fan 10 is at the same level as the ambient pressure, i.e. in the vicinity of reference numeral 14. In order to then deliver a barrier air flow through compressor bearing chamber 1 and compressor barrier air chamber 11, an ejector 18 is provided. This ejector 18 can also be referred to as an extractor and is connected to exhaust line 16. In this ejector 18, the barrier air flow supplied through exhaust line 16 is accelerated such that the barrier air flow that passes into the ejector 18 through exhaust line 15 is drawn off from the compressor bearing chamber 1. The pressure level of the barrier air flow deflected through exhaust line 16 from turbine bearing chamber 2 is utilized to deliver the barrier air flow through compressor bearing chamber 1. This pressure level is still relatively high at all operating points. As explained above, the pressure level of the barrier air flow conducted in exhaust line 16 is always sufficiently high, since the barrier air flow guided therein for the turbine bearing chamber is always branched off from the high-pressure compressor through supply line 17.

Downstream from ejector 18, an oil separator 20 is provided in exhaust line 19 which is then brought together and eventually terminates into the environment 14. The oil separator 20 is able to feed the amount of oil entrained by the barrier air flow back into the lubricating oil circuit of the gas turbine engine.

To clarify the pressure relationships in the barrier air system described herein, a few representative pressure values for a certain operating point will now be specified. For example, if a pressure of 1.0 bar prevails in environment 14 as well as downstream of fan 10, a pressure of 0.99 bar prevails in the compressor barrier air chamber 11 and a pressure of 0.97 bar prevails in exhaust line 15. In the compressor area downstream from labyrinth seal 13 and outside of the compressor barrier air chamber 11, a pressure of 0.98 bar then prevails while in supply line 17, which branches off from stage 4 of the high-pressure compressor 7, a pressure of 1.3 bars prevails. Then, a pressure of 1.24 bars prevails in the turbine barrier air chamber 12, which, after passing through turbine bearing chamber 2 and passing through ejector 18, and after mixing with the barrier air that arrives through exhaust line 15, is reduced to a pressure of 1.01 bars. This pressure is still sufficient to deliver the barrier air flow which is then merged from the two bearing chambers 1, 2 through oil separator 20 into environment 14, in which, as we have already stated, a pressure of 1.0 bar likewise prevails. Of course, these numerical values are merely sample values and a plurality of details especially of a design nature could be devised that differ completely from the embodiment which is shown simply as an example, without departing from the scope of the claims.

What is claimed is:

1. A gas turbine engine having at least one of a low-pressure compressor and fan and a high-pressure compressor, comprising:

a compressor bearing chamber supplied with oil;

a turbine bearing chamber supplied with oil;

a compressor barrier air chamber surrounding the compressing bearing chamber;

a turbine barrier air chamber surrounding the turbine bearing chamber;

a first barrier air flow supplied from one of the low-pressure compressor and fan to said compressor barrier air chamber;

a second barrier air flow supplied by the high-pressure compressor to said turbine barrier air chamber;

labyrinth seals sealingly arranged between the compressor bearing chamber and the compressor barrier air chamber and between the turbine bearing chamber and the turbine barrier air chamber, respective ones of said barrier flows passing through respective labyrinth seals at least partially into associated bearing chambers; and an ejector, wherein said first barrier air flow emerging from said compressing bearing chamber is mixed in said ejector with the second barrier air flow emerging from said turbine bearing chamber.

2. A gas turbine engine according to claim 1, wherein said gas turbine engine is an aircraft gas turbine.

3. A gas turbine engine according to claim 1, wherein an oil separator is arranged downstream from the ejector.

* * * * *